US011944883B2

(12) United States Patent
Burdette et al.

(10) Patent No.: US 11,944,883 B2
(45) Date of Patent: Apr. 2, 2024

(54) GALTON CONFIGURATION IN GOLF BALL RECEIVING APPARATUS AND SYSTEMS

(71) Applicant: Topgolf International, Inc., Dallas, TX (US)

(72) Inventors: Brian David Burdette, McKinney, TX (US); Gabriel Heath Denk, Wylie, TX (US); Justin Dean Pendleton, The Colony, TX (US); Michael Ryan Petri, Carrollton, TX (US)

(73) Assignee: Topgolf International, Inc., Dallas, TX (US)

( * ) Notice: Subject to any disclaimer, the term of this patent is extended or adjusted under 35 U.S.C. 154(b) by 0 days.

(21) Appl. No.: 18/296,897

(22) Filed: Apr. 6, 2023

(65) Prior Publication Data

US 2023/0338801 A1 Oct. 26, 2023

Related U.S. Application Data

(60) Provisional application No. 63/333,520, filed on Apr. 21, 2022.

(51) Int. Cl.

| | |
|---|---|
| ***A63B 67/02*** | (2006.01) |
| ***A63B 63/08*** | (2006.01) |
| ***A63B 69/36*** | (2006.01) |

(52) U.S. Cl.

CPC ..... *A63B 63/08* (2013.01); *A63B 67/02* (2013.01); *A63B 69/3694* (2013.01); *A63B 2225/54* (2013.01)

(58) Field of Classification Search

CPC . A63B 67/02; A63B 69/3691; A63B 69/3694; A63B 2225/54; B65B 5/08;

(Continued)

(56) References Cited

U.S. PATENT DOCUMENTS 675,478 A * 6/1901 Harkrider ..... A63F 7/3622 273/120 R
1,374,844 A * 4/1921 Flatow ..... A63F 7/02 273/120 R (Continued)

FOREIGN PATENT DOCUMENTS

CN 206007978 U 3/2017
CN 211062295 7/2020

OTHER PUBLICATIONS

International Search Report and Written Opinion in International Appln. No. PCT/US2023/019154, dated Jul. 31, 2023, 10 pages.

(Continued)

*Primary Examiner* — Laura Davison
(74) *Attorney, Agent, or Firm* — Fish & Richardson P.C.

(57) ABSTRACT

Systems and apparatus for receiving golf balls include an apparatus including: a body having an ingress and an egress for golf balls passing through the body, wherein each of the golf balls includes a radio frequency identification tag; at least one antenna of a radio frequency identification reader, the at least one antenna arranged with respect to the body to receive information from the golf balls for identification of the golf balls; and multiple protrusions located within the body, the multiple protrusions being positioned with respect to each other in a Galton configuration that both (i) impedes the golf balls from passing through the body without being read by the radio frequency identification reader, and (ii) allows the golf balls to pass through the body without jamming therein.

18 Claims, 9 Drawing Sheets

(58) Field of Classification Search
CPC ..... A63F 7/00; A63F 7/022; A63F 7/3622; G09B 23/02; G07F 1/048; G07F 11/04; G07F 11/08; G07F 11/34; A47F 1/08; A47F 1/082; A47F 1/087
USPC ..... 273/138.3, 138.4, 120 R; 446/168
See application file for complete search history.

(56) References Cited

U.S. PATENT DOCUMENTS

| | | | | |
|---|---|---|---|---|
| 2,752,727 | A * | 7/1956 | Cotton | A63F 7/3622 446/168 |
| 3,248,008 | A | 4/1966 | Meierjohan | |
| 3,328,033 | A * | 6/1967 | Hendry | A63B 63/00 273/127 R |
| 5,080,592 | A * | 1/1992 | Laghi | G09B 23/02 434/188 |
| 5,833,091 | A | 11/1998 | Palmer | |
| 6,287,212 | B1 | 9/2001 | Wetherell et al. | |
| 6,368,229 | B1 | 4/2002 | Wetherell | |
| 6,607,123 | B1 | 8/2003 | Jollifee et al. | |
| 7,056,221 | B2 | 6/2006 | Thirkettle et al. | |
| 7,059,974 | B1 | 6/2006 | Golliffe et al. | |
| 7,337,965 | B2 | 3/2008 | Thirkettle et al. | |
| 8,866,613 | B2 | 10/2014 | Luciano, Jr. | |
| 9,132,326 | B2 | 9/2015 | Caster et al. | |
| 9,339,697 | B2 | 5/2016 | Luciano et al. | |
| 10,463,923 | B1 | 11/2019 | Luciano | |
| 10,546,467 | B1 * | 1/2020 | Luciano, Jr. | G07F 17/3295 |
| 10,799,770 | B1 | 10/2020 | Semsak et al. | |
| 2004/0034440 | A1 * | 2/2004 | Middlebrook | G06Q 90/00 700/91 |
| 2023/0025901 | A1 * | 1/2023 | Kozakevich | G07F 17/3297 |

OTHER PUBLICATIONS

Range Servant America, "Golf Ball Elevator," Jan. 15, 2019, retrieved from URL :<https://rangeservant.us/product/golf-ball-elevator/>, 4 pages.

Range Servant, "Golf Ball Elevators," Jan. 15, 2019, retrieved from URL :<https://rangeservant.com/golf-driving-range-equipment/golf-ball-elevators/>, 5 pages.

Taoglas Antenna Solutions, "ISPC.91A.09.0092E Specification," 5dBi ISM Band 915MHz Embedded Ceramic Patch Antenna with Cable and Connector, Feb. 25, 2019, retrieved from URL: <https://www.taoglas.com/wp-content/uploads/2015/04/ISPC.91A.09.0092E.pdf>, 17 pages.

Claire Swedberg, "RFID Scores Well at TopGolf's Newest Entertainment Complex", RFID Journal, https://www.rfidjournal.com, Jan. 3, 2012, 9 pages.

Eric Weisstein, Wolfram Mathworld, Galton Board, Wolfram Research Inc., https://mathworld.wolfram.com/GaltonBoard.html, Jan. 12, 2022, 4 pages.

* cited by examiner

GALTON CONFIGURATION IN GOLF BALL RECEIVING APPARATUS AND SYSTEMS

CROSS-REFERENCE TO RELATED APPLICATIONS

This application claims benefit under 35 U.S.C. § 119(e) (1) of U.S. Provisional Application No. 63/333,520, filed on Apr. 21, 2022, which is incorporated by reference herein.

BACKGROUND

This specification relates to the use of golf balls having Radio Frequency Identification (RFID) tags, and in particular, to receiving and identifying such RFID equipped golf balls.

The game of golf has a long history, and in addition to traditional golf played on golf courses, driving ranges have been used by players to improve their game. Further, golf facilities have been developed in which golf balls with RFID tags are hit into targets that include RFID readers, allowing the creation of interactive golf games, where the successful hitting of a target with a golf ball is automatically identified in a computer system and reported back to the golfer to create a more exciting golf experience. This has encouraged new players to learn golf, resulting in a substantial increase in the interest in golf generally. Moreover, such golf facilities have experienced wide and growing popularity, which results in many millions of golf balls with RFID tags being hit each year.

SUMMARY

This specification describes technologies relating to RFID golf ball receiving and identifying apparatus and systems.

Systems and apparatus for receiving golf balls include an apparatus including: a body having an ingress and an egress for golf balls passing through the body, wherein each of the golf balls includes a radio frequency identification tag; at least one antenna of a radio frequency identification reader, the at least one antenna arranged with respect to the body to receive information from the golf balls for identification of the golf balls; and multiple protrusions located within the body, the multiple protrusions being positioned with respect to each other in a Galton configuration that both (i) impedes the golf balls from passing through the body without being read by the radio frequency identification reader, and (ii) allows the golf balls to pass through the body without jamming therein. The apparatus can be one of multiple ball receiving apparatuses included in at least one target of two or more targets for the golf balls in a system, e.g., at a golf range facility. The system can include one or more radio frequency identification readers associated with the least one target.

The apparatus can include a support surface located within the body, wherein the multiple protrusions include protuberances on the support surface. The support surface can be a first support surface, the apparatus can include a second support surface, the protuberances can be arranged in a Galton configuration on each of the first and second support surfaces, and each of the first and second support surfaces can be placed at an incline of between ten degrees and twenty degrees.

The incline of each support surface can be adjustable between ten degrees and twenty degrees. The apparatus can include horizontally oriented bars located within the body, the horizontally oriented bars being arranged in two columns extending between the first support surface and the second support surface, wherein a gap between the bars of the two columns is less than a diameter of a golf ball, and a distance between each pair of rods in each respective column is less than the diameter of a golf ball. Moreover, opposite sides of the body can be open to the environment.

The multiple protrusions can include horizontally oriented bars located within the body. Each of the bars can be attached with the body through a pivot. The bars can be removably attached with the body.

The bars can be positioned in a series of rows that alternate between an even number of bars and an odd number of bars in each row, and the body can include inward-directed flaps positioned adjacent to a proper subset of the rows having a fewer number of bars. The bars can be positioned in a series of rows having a same number of bars in each of the rows, and the body can include inward-directed flaps positioned on alternating sides of the bars in each row.

The apparatus can include holders, wherein each of the holders is configured to removably receive a respective proper subset of the bars. Each of the holders can be separate and distinct from the body, and the body can include respective surfaces that are each shaped to removably receive any one of the holders.

The apparatus can include an access door forming a majority of an area of at least one side of the body. The egress can include two egresses, a bottom support surface within the body can have a first portion sloped downward toward a first of the two egresses and a second portion sloped downward toward a second of the two egresses. The multiple protrusions can be located within a read zone of the body, and the at least one antenna can be placed on a side of the read zone, above the read zone, and/or below the read zone.

Various embodiments of the subject matter described in this specification can be implemented to realize one or more of the following advantages. The described structural configuration can prevent golf balls from passing too quickly through the receiving apparatus, thus reducing (or eliminating) the risk that a golf ball will not be read by an RFID reader, while also allowing the balls to be read quickly. The internal design of the ball receiving apparatus, including the dimensions and spacing of protrusions located therein, can reduce (or eliminate) the risk that golf balls will get locked up with each other (or impeded by debris) inside the receiving apparatus, thereby preventing ball jams in the receiving apparatus that would require maintenance during use. An access door of the design can facilitate removal of any debris (e.g., leaves, windblown trash, snow or ice) that gets into the apparatus. A modular design allows individual swapping out of parts in case of failure or upgraded and/or expanded design. This can also increase the longevity of the apparatus and minimize maintenance requirements.

One or more interior support surfaces of the receiving apparatus can be sloped so as to ensure the read golf balls leave the apparatus quickly enough to prevent a jam or a backup of balls inside the apparatus. These interior support surface(s) can include the protrusions and so can also facilitate slowing the balls down to provide enough time to read the RFID tags, without also causing a jam or ball backup. The design can include horizontally oriented bars that the balls hit and bounce off of, thus causing the balls to rotate/reorient more while passing through the apparatus, thereby maximizing the chances of an accurate read of the RFID tag while the ball moves through the apparatus. The bars can be the protrusions arranged in a Galton pattern or be separate from the protrusions, in which case, the use of crossbars for the balls to bounce off of, in combination with protuberances arranged in a Galton pattern on one or more interior surfaces, which support the balls as they roll through the apparatus under the influence of gravity, can maximize the number reorientations of the balls as they pass through the apparatus and ensure the balls do not pass too quickly through the apparatus (thus effectively eliminating the risk that a golf ball will not be read) while also preventing any ball jams or backups within the apparatus (even at very high ball throughput, and potentially when debris is present inside the apparatus).

The details of one or more embodiments of the subject matter described in this specification are set forth in the accompanying drawings and the description below. Other features, aspects, and advantages of the invention will become apparent from the description, the drawings, and the claims.

BRIEF DESCRIPTION OF THE DRAWINGS

Like reference numbers and designations in the various drawings indicate like elements.

DETAILED DESCRIPTION

Figure 1A:
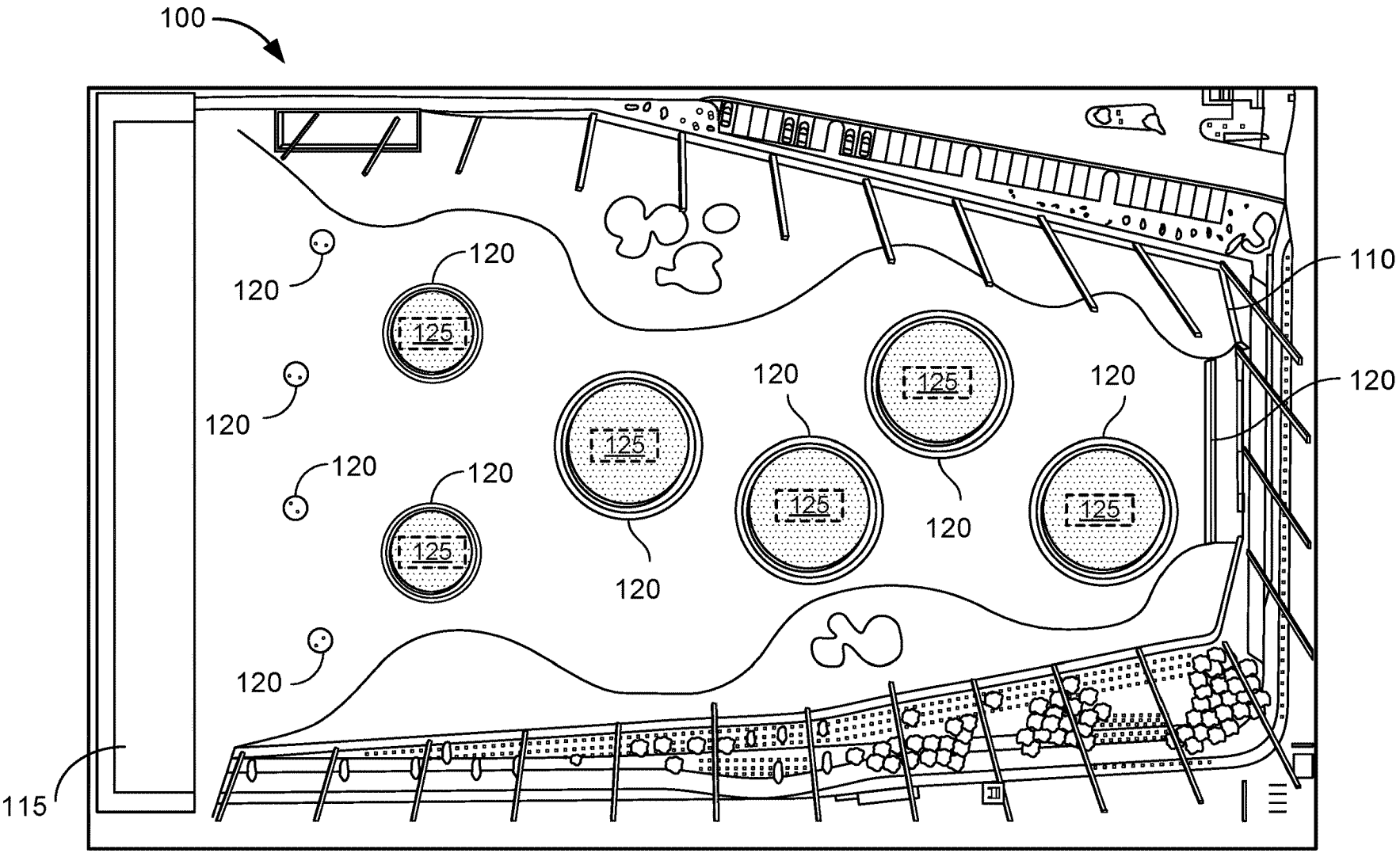
FIG. 1A shows an example of a golf facility including targets for RFID equipped golf balls.

FIG. 1A shows an example of a golf facility 100 including targets 120 for RFID equipped golf balls. The golf facility 100 includes a golf range 110 and a building 115. The golf range 110 can be of various shapes and sizes, but will typically be 300-500 feet wide and 600-900 feet long. The golf range 110 can be flat or include small hills or one or more inclines, and can also include hazards, such as water and sand traps. Note that such hazards need not include actual water and sand, but can simply be colored to look like water or sand. Moreover, the golf range 110 can be composed of real grass or artificial turf.

Included in the golf range 110 are targets 120 having different sizes and being different distances from the building 115, where people stand to hit golf balls toward the targets. The targets can be grouped into distance categories that generally represent their distance from the building 115, and the targets can have various shapes, such as the circular shapes of the main targets and the rectangular shape of the trench target at the end of the range 110. Other shapes for the targets 120, as well as different numbers of targets 120 than shown, are also possible.

Each target 120 includes one or more systems 125 for receiving and identifying the golf balls that enter the target 120. For example, each target can include netting that funnels the golf balls into a nearest receiver box which is part of a system 125, where RFID tags inside the balls are read as each ball passes through the receiver box. Each receiver box can be equipped with an RFID antenna that is connected with an RFID reader, which in turn is connected with a computer system for the golf facility 100 that manages the golf games. Moreover, one or more of the targets 120 can include discrete sections of nets such that information regarding which portion of the target a particular golf ball lands in can be determined, and different points or game features can be applied accordingly. Each such net section can have its own receiver box and RFID antenna, and multiple such antennas inside a target 120 can have their signals be multiplexed into a single RFID reader to reduce the total number of RFID readers needed for the golf facility 100.

Once the golf balls are read and collected within each target 120, they can be manually or automatically returned to the building 115 for another hit. For example, each target can include a collection point that includes a helical screw to capture and direct the golf balls to a vacuum intake point where the golf balls can be individually sucked through pneumatic tubes back to the building 115. Moreover, the golf balls can be individually washed and read again by an additional RFID equipped receiver at the building 115 before being placed back into play.

Figure 1B:
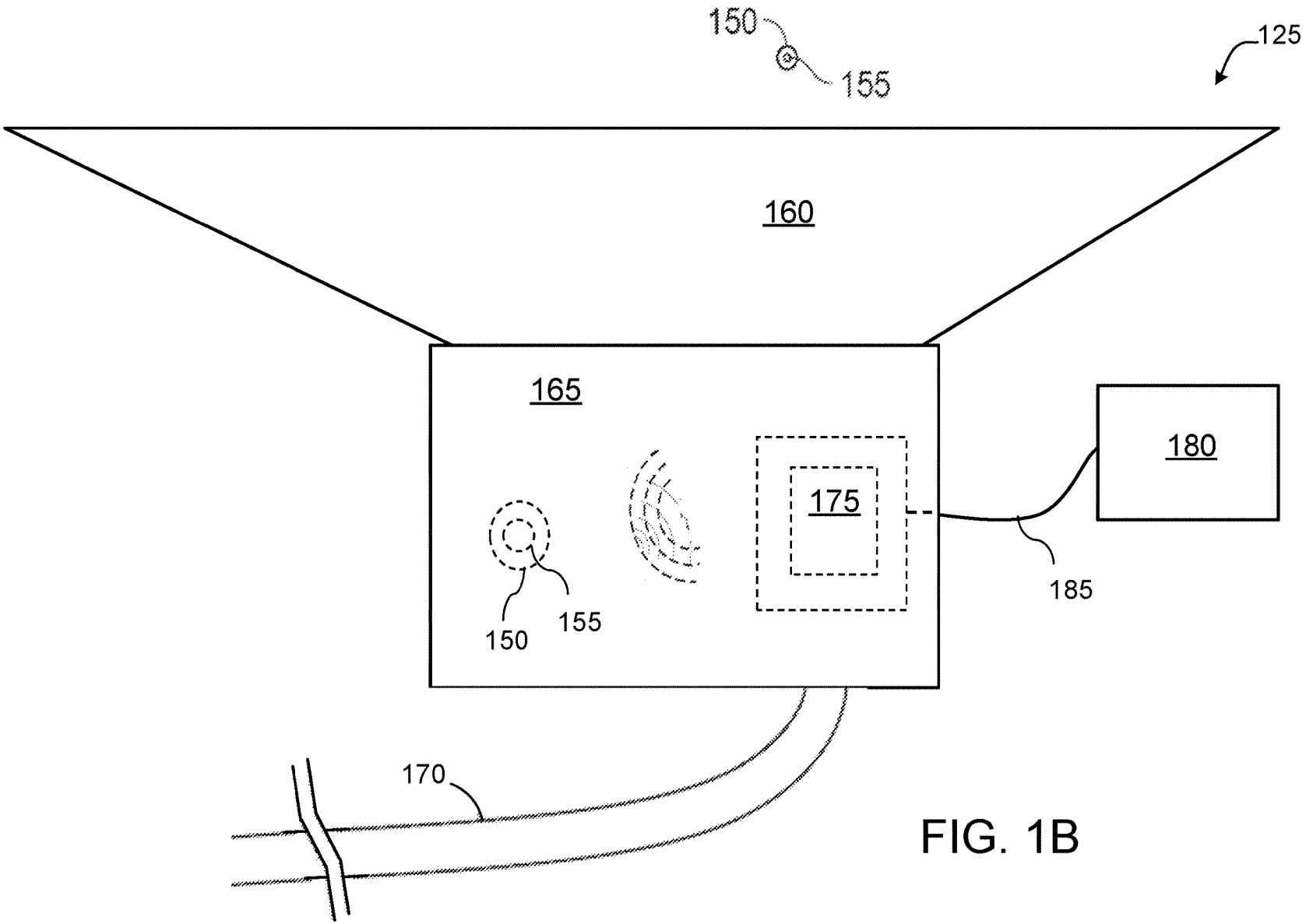
FIG. 1B shows an example of a receiving and identifying system for RFID equipped golf balls, as can be used in a golf facility.

FIG. 1B shows an example of a system 125 for receiving and identifying RFID equipped golf balls, as can be used in the golf facility 100. Each golf ball 150 includes an RFID tag 155. As will be appreciated, various RFID structures and designs can be used, but the RFID tag 155 will generally not be visible as it is embedded in the golf ball 150; the tag 155 is shown in FIG. 1B for purposes of clarity in this disclosure. Moreover, each of the golf balls discussed below is an RFID equipped golf ball. As the golf ball 150 lands in the netting of a target 120, the netting (a target net 160 or target net section 160) funnels the golf ball into a golf ball receiving apparatus 165. Further, in some implementations, the balls 150 that pass through the apparatus 165 are then routed through one or more tubes 170 back to the building 115.

Inside the receiving apparatus 165, the ball 150 rolls and/or bounces past an RFID antenna 175 that is connected to an RFID reader 180. The RFID antenna 175 obtains wireless signals responsive to the tag 155 in the ball 150, and the RFID reader 180 processes these signals to determine the identification data of the ball 150 and forwards that data to the facility's back-end software, to determine which target 120 (or which zone of the target 120) the specific ball entered, from which data a score and/or game occurrence can be determined. Further data (beyond the RFID tag's unique number) can also be sent to the facility's back-end software, including signal strength (RSSI), timestamp, RFID channel (radio frequency), and antenna number. Note that the receiving apparatus 165 includes an antenna 175, but need not include control circuitry. Rather, the antenna 175 can be connected to the RFID reader 180 using a wire 185, and all control circuitry that implements the RFID functionality can be remote from the receiving apparatus 165.

Nonetheless, in some implementations, some or all of the control circuitry is integrated into the receiving apparatus 165. The antenna 175 can be separate from the control circuitry or integrated into the control circuitry. In some implementations, the antenna 175 is outside the receiving apparatus 165 rather than inside. In some implementations, the antenna and control circuitry are built into a single integrated circuit module that is embedded in the receiving apparatus 165. Thus, as used herein, an RFID antenna can refer to an RFID chip or other compact electronics package. Moreover, the antenna 175 can be placed in various positions, as described in detail below, and in some implementations, more than one antenna 175 can be used. For example, a first RFID antenna 175 can have a first orientation, and a second RFID antenna 175 can have a second orientation that is 90 degrees away from the first orientation, which improves the chances of reading the golf ball's embedded RFID tag.

The antenna 175 can be near-fielded and have a polarization type, e.g., linear or circular type polarization. In addition, the antenna 175 can be accompanied by a wall or walls made of RF shielding or absorbing material(s) to reduce RF interference. Moreover, various RFID technologies can be used in various implementations, including passive or active RFID, read-only, field-programmable or read/write RFID tags, and different frequency bands can be used to achieve different ranges and data speeds (e.g., Low Frequency (LF) from 120-150 kHz, High Frequency (HF) around 13.56 MHz, and Ultra High Frequency (UHF) about 433 MHz or 865-868 MHz or 902-928 MHz). In general, more durable but also less expensive RFID tags 155 should be used given the regular, large impacts that are experienced by the golf balls 150 in which they are embedded.

The RFID reader 180 can cause the antenna 175 to transmit a radio signal (e.g., an encoded radio signal) to interrogate the RFID tag 155. The RFID tag 155 receives the signal and then responds with identification and potentially other information. While shown as a single box attached to the golf ball receiving apparatus 165, it will be appreciated that the RFID reader 180 can be distributed among two or more locations. For example, each target net section 160 can have its own receiving apparatus 165 that includes one or more antennas that are electrically connected with one or more RFID reader circuits located elsewhere. Thus, the RFID reader 180 can be connected with multiple antennas and can operate all of the connected antennas. Various other combinations of RFID antennas and reader circuitry/processors can be used with each target, depending on the size of the target and the number of golf balls 150 to be read in a given period of time (e.g., based on average or peak ball volume).

Each receiving apparatus 165 includes a structural configuration that both impedes the golf balls 150 from passing through without being read by the RFID reader and allows the golf balls 150 to pass through without locking up with each other and forming a jam or otherwise getting backed up inside the apparatus 165. This structural configuration can be generally understood as multiple protrusions located within the apparatus 165 that are arranged in a pattern that corresponds to the configuration of pegs on a Galton board. These protrusions are positioned with respect to each other so as to ensure that the balls hit the protrusions and are thus slowed down as they pass through the apparatus 165. However, the protrusions are also sized and spaced from each other in a manner that allows the golf balls 150 to pass through the apparatus 165 without jamming or backup therein.

Figure 2A:
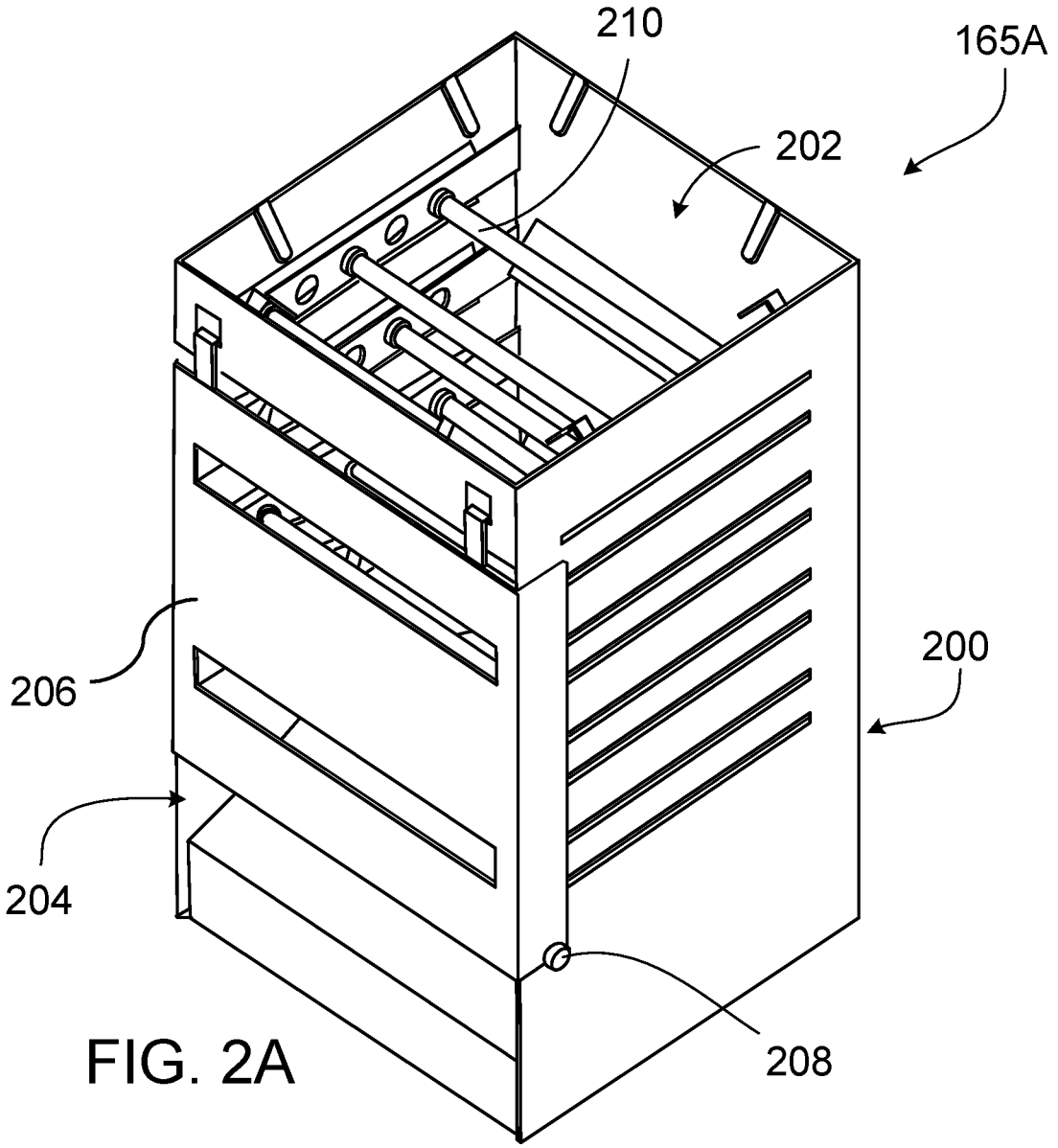
FIG. 2A is an isometric view of an example of a golf ball receiving apparatus.

FIG. 2A is a perspective view of an example of a golf ball receiving apparatus 165A. The apparatus 165A includes a body 200 that receives the balls 150 through an ingress 202 and removes the balls 150 through an egress 204. In some implementations, the body 200 has a rectangular shape. In some implementations, the body 200 has a cylindrical shape. In some implementations, the body 200 has another geometrically suitable shape. The body 200 can be built using metal, plastic, or other materials, or a combination thereof, but note that the use of metallic materials helps to contain the RF (radio frequency) fields so as to prevent the reader from reading balls outside the body 200.

In some implementations, the body 200 includes an access door 206 forming a part of an area of at least one side of the body 200. The access door 206 can be a solid metal sheet or a perforated metal sheet, or be built from other material(s) as with the body 200. In some implementations, the body 200 includes an access door 206 forming a majority of an area of at least one side of the body 200, which facilitates access to the interior of the body 200 for service, including cleaning out any debris. In some implementations, the access door 206 is attached with the body 200 using a pivot 208 at one or more locations. In some implementations, the access door 206 is entirely removable from the body 200.

In the example apparatus 165A, the protrusions arranged in a Galton configuration are multiple bars 210. These bars (or crossbars) 210 are thus positioned with respect to each other in a configuration that both impedes the golf balls 150 from passing through the body 200 without being read by the RFID reader 180, and allows the golf balls 150 to pass through the body 200 without locking up with each other and forming a jam or otherwise getting backed up inside the apparatus 165A. Further, as each ball 150 bounces off a bar 210, it will typically be reoriented in space, thus facilitating reading of the RFID tags 155 inside the balls 150. In some implementations, each bar from the multiple bars 210 has a cylindrical shape, as shown, but other shapes are possible. In some implementations, each bar from the multiple bars 210 has a cross-section shaped like a rhombus or a hexagon. In some implementations, each bar from the multiple bars 210 is a chevron-shaped crossbar. In some implementations, each bar from the multiple bars 210 has a U shape or a C shape (with opening facing down) as these shapes can function like cylinders but be more readily fabricated from sheet material. Moreover, each bar from the multiple bars 210 can be attached to the body using a pivot.

Figure 2B:
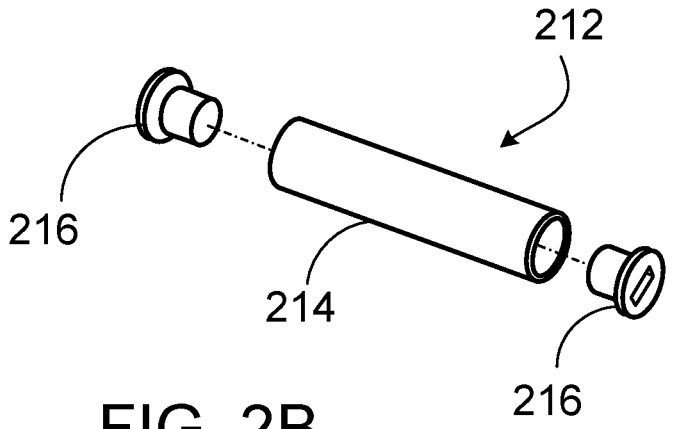
FIG. 2B shows an example of a bar, as can be used in a golf ball receiving apparatus.

FIG. 2B shows an example 212 of bars 210, as can be used in a golf ball receiving apparatus 165. As illustrated, the pivot attachment can include an axle 214 attached to a bearing 216 on one or both sides of the axle 214. This configuration allows the bar 212 to freely spin when installed in a receiving apparatus 165, which can result in a better distribution of wear on the bars (on all sides) over time and therefore increased durability and lifespan. Further, regardless of how the bars 210, 212 are attached within the body of the apparatus 165, each bar can be identical in shape and dimensions as each other bar. Thus each bar can be interchangeable with any other bar, thus facilitating maintenance and repairs.

Figure 2C:
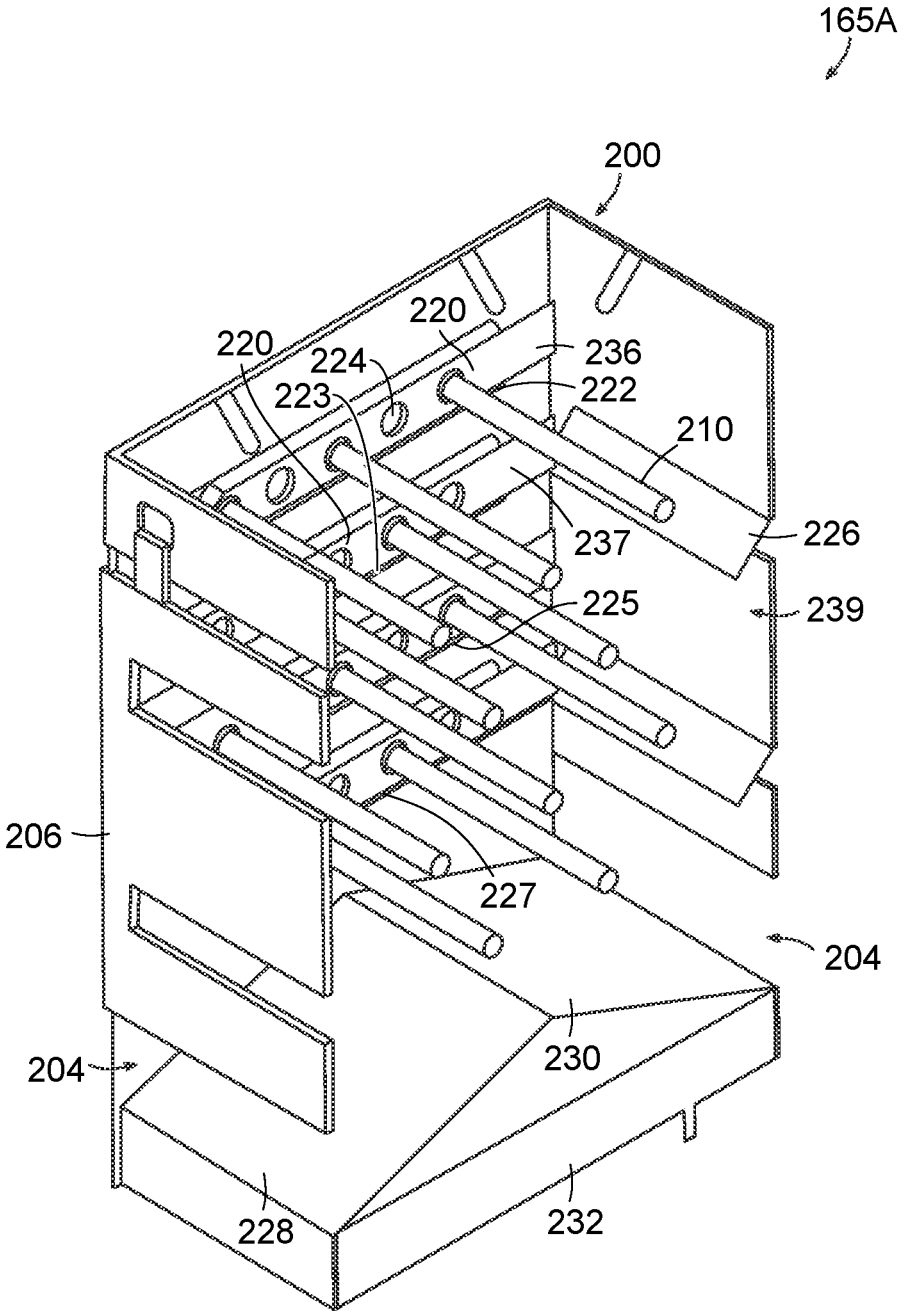
FIG. 2C is an isometric, cutaway view showing internal structures of the golf ball receiving apparatus of FIG. 2A.
Figure 2D:
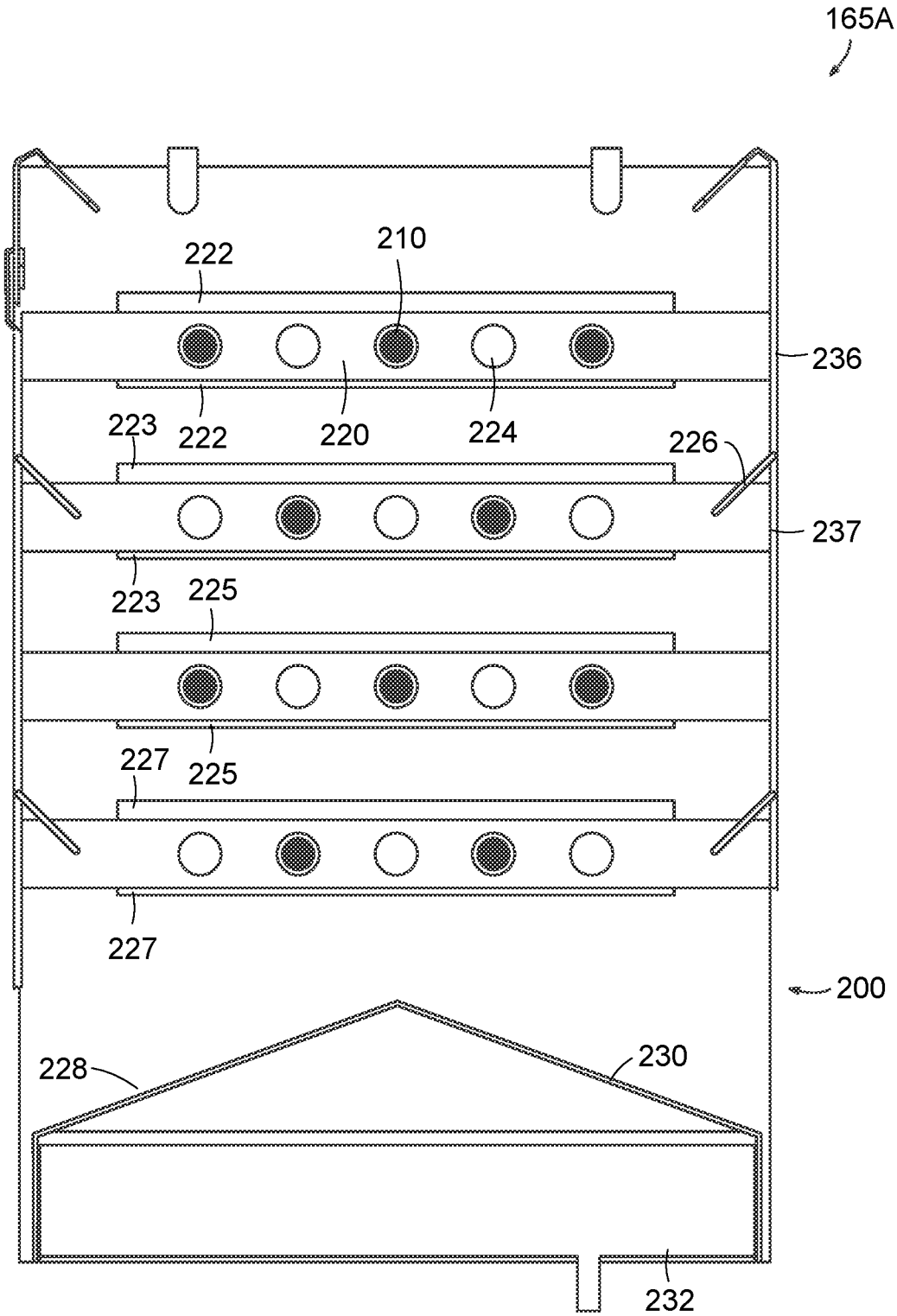
FIG. 2D is a side, cutaway view showing internal structures of the golf ball receiving apparatus of FIG. 2A.

FIG. 2C is a perspective, cutaway view showing internal structures of the golf ball receiving apparatus of FIG. 2A. FIG. 2D is a side, cutaway view of the golf ball receiving apparatus of FIG. 2A. In these figures, the Galton configuration of the bars 210 is readily visible. The bars 210 can be made of metal, plastic, or other materials, or a combination thereof, but note that avoiding the use of metallic materials helps prevent the bars 210 from blocking some of the RF fields, which can impede RFID reads in the upper part of the body 200. In some implementations, each of the bars 210 has a diameter between five and one hundred millimeters (mm)

(inclusive). In general, the bars 210 should have dimensions that are sufficiently large, given the material they are made from, to maintain their strength and durability during use over long periods of being impacted by many golf balls.

Once the dimensions of the bars 210 are determined, then they are positioned in the Galton pattern with small enough distances between their outer surfaces to effectively ensure that each golf ball 150 passing through the apparatus 165A will hit at least one bar 210 (or slide flap 226 discussed below) regardless of the angle of the ball's incoming trajectory. Thus, each ball 150 is essentially guaranteed to be redirected (impeded) and likely reoriented at least a couple times as it travels through the body 200 of the apparatus 165A, thereby facilitating reading of the RFID tag therein. However, if the bars 210 are positioned too close to each other, then the balls 150 can form jams inside the apparatus 165A under high ball throughput conditions or when debris is present inside the apparatus 165A, and so the positioning of the bars 210 should provide distance(s) between their outer surfaces that are wide enough (but not too wide) to effectively ensure that no ball jams can be formed inside the apparatus 165A.

The spacing between the bars 210 can be determined based on a diagonal pathway of a golf ball 150 passing through the bars 210 and the size of the ball 150. In general, the spacing between the exterior surfaces of the neighboring bars 210 should be at least slightly larger than the diameter of a golf ball (42.7 mm), but as the distance between the bars 210 gets closer to the diameter of a golf ball, the risk of balls jams and/or backups in the apparatus 165 rises. In some implementations, the distance between the exterior surface of each pair of bars 210 (e.g., with every group of three bars forms an equilateral triangle) is between 44 and 64 mm (inclusive). In some implementations, the distance between the exterior surface of each pair of bars 210 is between 49 and 59 mm (inclusive).

However, the optimal spacing can depend on the size and shape of the bars 210, as well as whether or not the bars 210 are uniformly distributed in the Galton pattern, and so the optimal spacing for a particular implementation can be determined using ball jam/backup and RFID read data from experimental testing for a given apparatus 165. Also note that the importance of the spacing value applies to the bars 210 that are horizontally positioned from each other (i.e., are in the same horizontal row 236) and to the bars 210 that are on different but adjacent rows (i.e., in rows 236, 237) as well. In other words, each bar must have at least a 42.7 mm clearance in all directions for the golf ball 150 to successfully move through the apparatus 165A.

The bars can be removably attached to the body 200, so a bar 210 can be readily replaced when it is damaged, and thus one or more (or all) bars 210 can be removed to facilitate cleaning of the interior of the apparatus 165A. In some implementations, the golf ball receiving apparatus 165A includes holes formed on one or both sides of the body 200 to removably receive the bars 210. But in some implementations, the golf ball receiving apparatus 165A includes an intermediate separate element, such as a holder 220, that can be installed into a respective surface 222 of the body 200. The body 200 can include multiple respective surfaces, such as the respective surfaces 222, 223, 225, and 227, installed on or formed from the body 200, e.g., in a parallel configuration. In some implementations, each respective surface 222, 223, 225, 227 is a recess formed in the body 200. In some implementations, each respective surface 222, 223, 225, 227 is shaped to removably receive one holder such as a holder 220. Each holder 220 is a separate and distinct element from the body 200. In some implementations, the holder 220 is a rectangular tray, which can be made of metal, plastic, or other materials, or a combination thereof. Each holder 220 can be a perforated sheet that includes one or more holes 224 configured to removably receive a respective proper subset of the multiple bars 210 to form the Galton pattern, as shown. The holders 220 allow a whole set of bars to be replaced at once instead of needing to replace the bars individually, which can lead to more down time for the golf ball reader apparatus during maintenance operations. Thus, using holders 220 for the bars 210 facilitate repair and cleaning of the apparatus 165A.

In the example shown, the rows alternate between having an odd number of bars 210 (e.g., in row 236) and an even number of bars 210 (e.g., row 237). As will be appreciated, this even-odd alternating pattern is a result of the particular width of the body 200 and this width being constant all the way through the read zone 239. Thus, to prevent balls from being able to partially circumvent the Galton pattern of bars 210, in some implementations, the body 200 includes multiple inward-directed flaps, such as flap 226, positioned adjacent the rows that include fewer bars 210 (e.g., row 237). In some implementations, the flaps 226 are integrally formed from the body 200, e.g., the flaps 226 can be inward bent portions of the metal sheet forming the body 200. In some implementations, the flaps 226 are removably attached to the body 200 and seated in a recess formed in the body 200, as done for the holders 220. In some implementations, the flaps 226 can be fastened to the inner surface of the body 220. Moreover, in some implementations, the Galton pattern does not have rows of bars with alternating even and odd numbers of bars; for example, every row can have the same number of bars, and each row can have a flap 226 at only one end, where this end would alternate from each row to the next.

As described earlier, in reference to FIG. 2A, the golf balls 150 leave the apparatus 165 through the egress 204. As shown in FIGS. 2C and 2D, the egress 204 can include two egresses 204. Thus, a bottom support surface within the apparatus 165A can have a first portion 228 and a second portion 230, where the first portion 228 is sloped downward toward a first of the two egresses 204, and the second portion 230 is sloped downward toward a second of the two egresses 204. In some implementations, the downward slopes of the first and second portions 228 and 230 are between 10 and 20 degrees (inclusive) or between 10 and 15 degrees (inclusive). This slope causes the balls 150 to leave the apparatus 165A under the force of gravity even in situations where debris is present or inclement weather tilts the apparatus or where the netting has heterogeneously stretched/aged and tilted the overall assembly. In some implementations, each support surface portion 228, 230 is adjustable, such that the slope can be varied within the range (10-20 or 10-15 degrees) as needed. Note that setting the slope to be as close to the minimum angle needed to avoid jams and backups (and tolerate situations where the apparatus 165 is not level) can facilitate RFID reading of the balls since they will be over the antenna for a longer period of time.

In some implementations, the interior support surface 228, 230 is made of a polymer-based material (e.g., a thermoformed polymer material or plastic sheet), polymer composite, or a combination thereof that protects an antenna 232 from damage. In some implementations, the interior support surface 228, 230 includes protuberances arranged in a Galton pattern, as described in further detail below. The antenna 232 (an example of antenna 175) is positioned with respect to the read zone 239 such that the balls 150 can be read as they are slowed down by the bars 210 within the body 200, and optionally by the protuberances on the support surface 228, 230. In the example shown, the antenna 232 is placed below the read zone 239. In some implementations, the apparatus 165, 165A can include one or more antennas placed in different configurations.

Figure 3A:
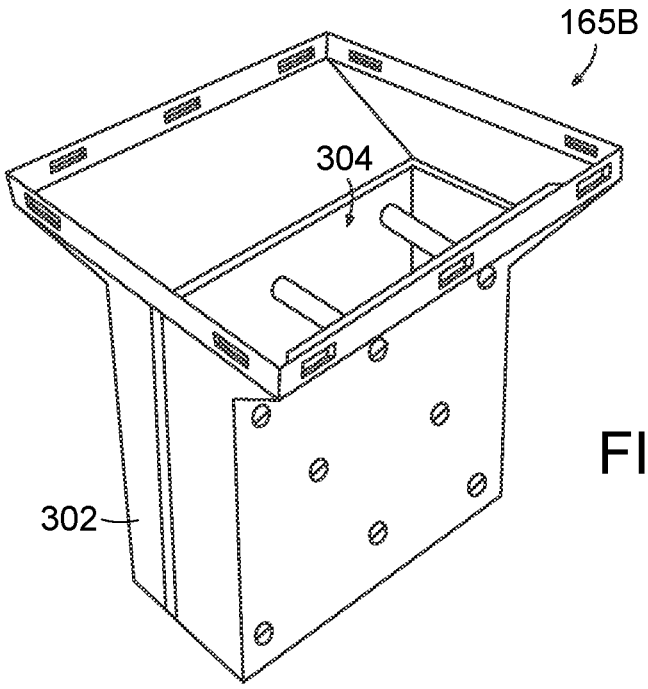
FIG. 3A is a perspective view of another example of a golf ball receiving apparatus.

FIG. 3A is a perspective view of another example of a golf ball receiving apparatus 165B. The apparatus 165B is similar to the apparatus 165A in that the protrusions arranged in a Galton configuration are horizontally oriented bars. However, the RFID antenna 302 (an example of antenna 175) is positioned on the side of the read zone 304, rather than below it.

Figure 3B:
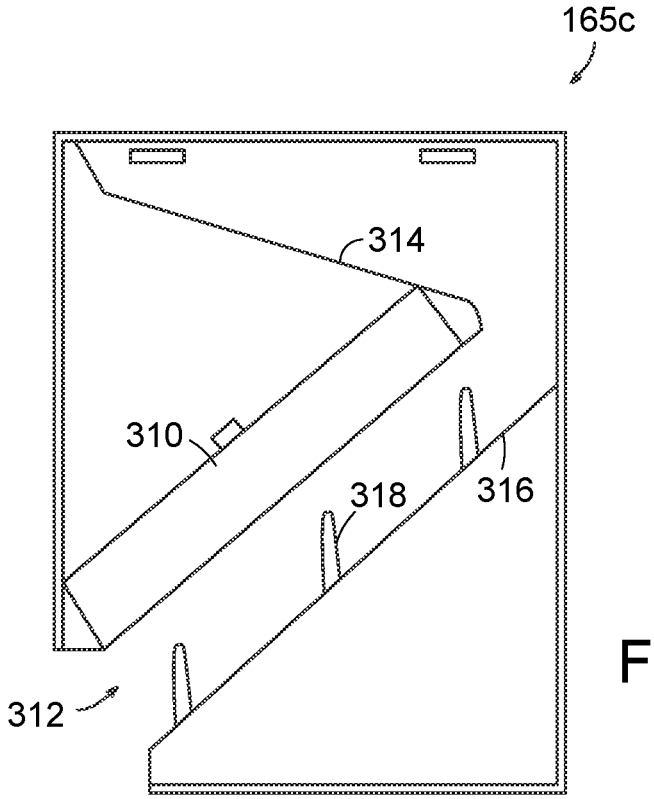
FIG. 3B is a side, cutaway view of yet another example of a golf ball receiving apparatus.

FIG. 3B is a side, cutaway view of yet another example of a golf ball receiving apparatus 165C. In this example, the RFID antenna 310 (an example of antenna 175) is positioned above the read zone 312. In addition, the apparatus 165C includes a first support surface 314 (without protuberances) above the RFID antenna 310 and a second support surface 316 below the RFID antenna 310. In addition, the protrusions arranged in a Galton configuration in the apparatus 165C are protuberances 318 arranged on the second support surface 316. Note that this implementation includes no horizontal rods arranged in a Galton pattern. Further, in some implementations, the protuberances arranged in the Galton configuration can be placed on the first support surface 314.

Figure 4A:
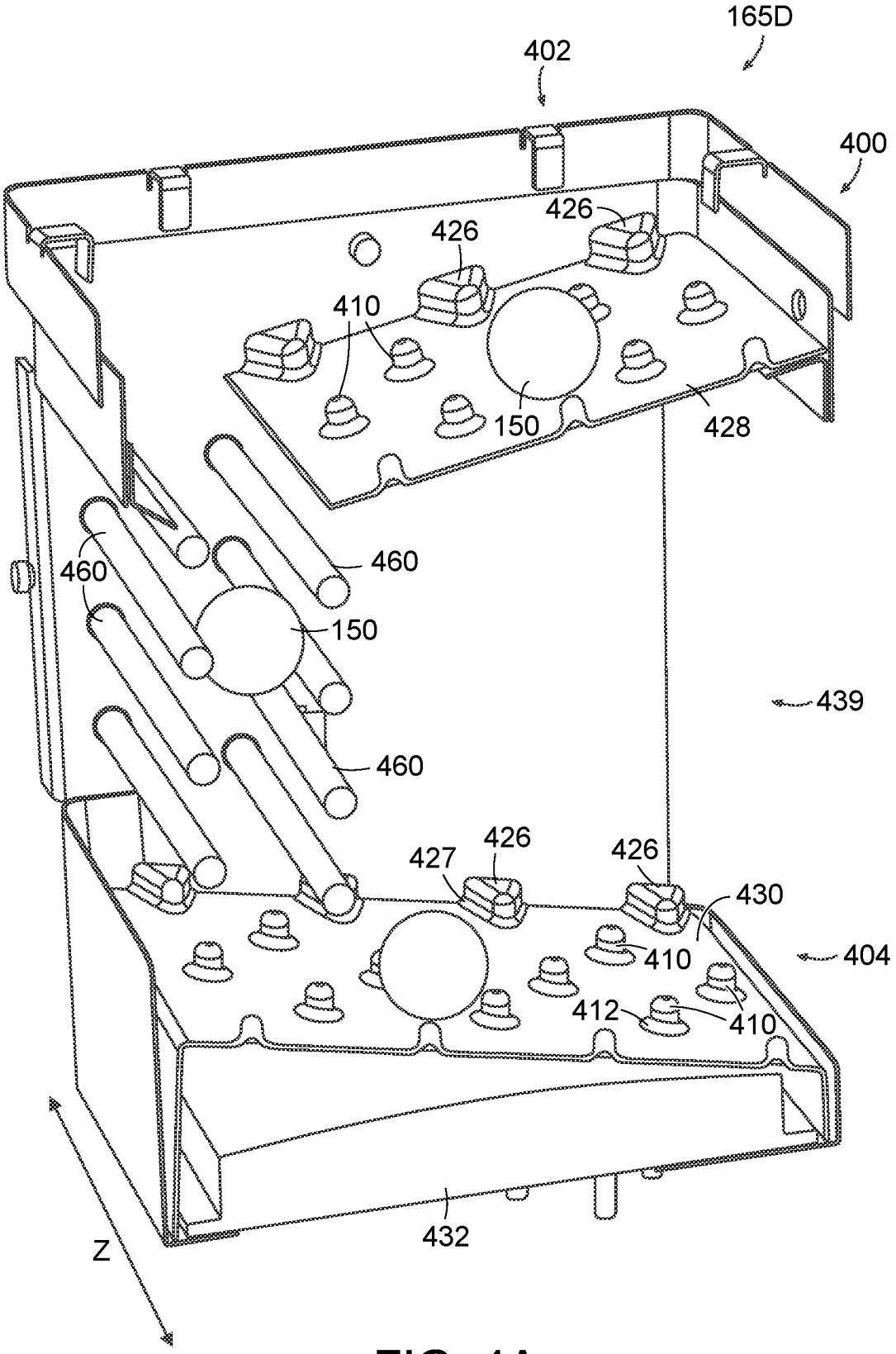
FIG. 4A is a perspective, cutaway view of an additional example of a golf ball receiving apparatus.

FIG. 4A is a perspective, cutaway view of an additional example of a golf ball receiving apparatus 165D. The apparatus 165D includes a body 400 that receives the balls 150 through an ingress 402 and removes the balls 150 through an egress 404. In some implementations, the body 400 has a rectangular shape. In some implementations, the body 400 has a cylindrical shape. In some implementations, the body 400 has another geometrically suitable shape. The body 400 can be built using metal, plastic, or other materials, or a combination thereof, but note that the use of metallic materials helps to contain the RF fields so as to prevent the reader from reading balls outside the body 400.

In general, the body 400 can include any of the features described above in for body 200 of the golf ball receiving apparatus 165A, such as the access door 206, e.g., the access door for the apparatus 165D can be attached by the pivot(s) 208, can be entirely removable from the body 400, and/or can form a majority of an area of at least one side of the body 400. Moreover, in some implementations, one or two sides of the apparatus 165D are left open (as shown) since the golf balls 150 are fully contained by the two columns of bars/rods 460 (as described further below). This provides the advantage of decreasing the total weight of the apparatus 165D, which may be hung from the underside of a net funnel, as well as making clearing out any debris (e.g., leaves, wind-blown trash, and/or snow/ice) that has found its way into the apparatus 165D very simple. In some cases, a person can quickly clear out any debris by simply directing a leaf blower at the apparatus 165D, without having to move or remove any parts of the apparatus 165D.

In the receiving apparatus 165D, the protrusions arranged in a Galton configuration are multiple protuberances 410 arranged on one or more support surfaces 428, 430. These protuberances 410 are thus positioned with respect to each other in a configuration that both impedes the golf balls 150 from passing through the body 400 without being read by the RFID reader 180, and allows the golf balls 150 to pass through the body 400 without locking up with each other and forming a jam or otherwise getting backed up inside the apparatus 165D. In some implementations, each protuberance from the multiple protuberances 410 has a cylindrical shape, as shown, but other shapes are possible. In some implementations, each protuberance from the multiple protuberances 410 has a cross-section shaped like a rhombus or a hexagon. In some implementations, each protuberance from the multiple protuberances 410 is chevron-shaped.

In some implementations, each support surface 428, 430 also includes side protuberances 426, which are similar to the side flaps 226 discussed above, which are positioned in the rows that include fewer protuberances 410. These protuberances 426 (shaped as triangles in this example, but other shapes are possible) help to impede the balls 150 passing through the apparatus 165D. In addition, these protuberances 426 help ensure that the balls 150 leaving each support surface 428, 430 are distributed evenly along the depth (Z) dimension of the apparatus 165D, which can facilitate high throughput. The protuberances 426 also solve the problem of balls getting caught between the inner walls of the sheet metal body and the protuberances 410.

Each protuberance 410, 426 can have a base that is wider than its top, and in some implementations each protuberance 410, 426 has a lower portion 412, 427 that is curved (a fillet at the bottom of each protuberance 410, 426) to generally correspond to the curve of the golf ball 150. Note that the fillet between each protuberance 410, 426 and the support surface can be considerably larger or considerably smaller than the radius of a golf ball and still function well. Some or all of the protuberances 410, 426 can be integrally formed with their respective support surfaces 428, 430, such as when each support surface 428, 430 is made of a polymer-based material (e.g., a thermoformed polymer material or plastic sheet), polymer composite, or a combination thereof. In some implementations, some or all of the protuberances 410, 426 can each be attached to its support surface 428, 430 using a pivot, as can be implemented for the multiple bars 210 attached to the body 200.

In some implementations, bars (or crossbars) 460 are also included in the apparatus 165D and are positioned in two columns that form a vertical channel for the balls 150 in a configuration that both impedes the golf balls 150 from passing through the body 400 without being read by the RFID reader 180, allows the golf balls 150 to pass through the body 400 without locking up with each other and forming a jam or otherwise getting backed up, and also serves to reorient the balls 150 as they bounce off the bars 460, thus facilitating reading of their RFID tags. An antenna 432 is protected from damage by the interior support surface 430. The antenna 432 (an example of antenna 175) is positioned with respect to the read zone 439 such that the balls 150 can be read as they are slowed down by the bars 460 and/or the protuberances 410, 426 within the body 400.

In some implementations, each bar from the multiple bars 460 has a cylindrical shape, as shown, but other shapes are possible. In some implementations, each bar from the multiple bars 460 has a cross-section shaped like a rhombus or a hexagon. In some implementations, each bar from the multiple bars 460 is a chevron-shaped crossbar. In some implementations, each bar from the multiple bars 460 has a U shape or a C shape (with opening facing down) as these shapes can function like cylinders but be more readily fabricated from sheet material. Moreover, each bar from the multiple bars 460 can be attached to the body 400 using a pivot.

In some implementations, the bars 460 are removably attached to the body 400, e.g., seated in a recess formed in the body 400. Further, in some implementations, holders can be used for the bars 460, such as described above for the holders 220 of the bars 210. The bars 460 can be made of metal, plastic, or other materials, or a combination thereof, but note that avoiding the use of metallic materials helps prevent the bars 460 from blocking some of the RF fields, which can impede RFID reads in the upper part of the body 400. In some implementations, each of the bars 460 has a diameter between five and one hundred mm (inclusive). In general, the bars 460 should have dimensions that are sufficiently large, given the material they are made from, to maintain their strength and durability during use over long periods of being impacted by many golf balls.

Figure 4B:
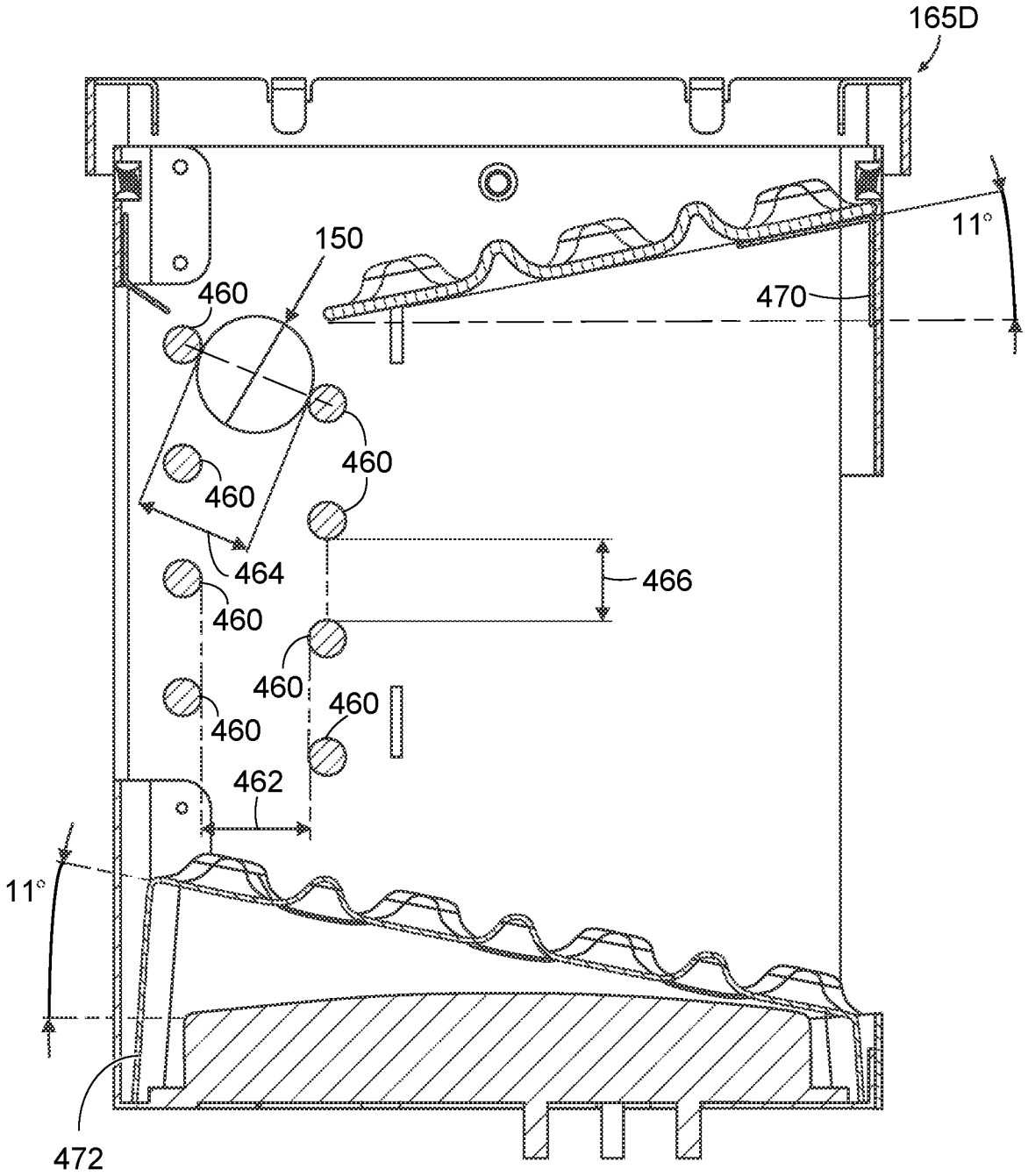
FIG. 4B is a side, cutaway view of the golf ball receiving apparatus of FIG. 4A.

Once the dimensions of the bars 460 are determined, the positioning between the bars 460 can be set to form the vertical channel noted above. FIG. 4B is a side, cutaway view of the golf ball receiving apparatus 165D of FIG. 4A. The horizontal distance 462 between the outer surfaces of the bars 460 in the two columns (i.e., the horizontal gap for the ball 150) is kept small enough (less than the diameter of a golf ball 150) to ensure that each golf ball 150 passing through the apparatus 165D will hit most of bars 460 because the ball 150 cannot travel straight down. In this example, the distance 462 is 39.77 mm. Additionally, the angled distance 464 between the outer surfaces of the bars 460 in the two columns (i.e., the angled gap for the ball 150) is kept large enough (more than the diameter of a golf ball 150) to ensure that each golf ball 150 can move along an angled path downward without getting jammed/backed up, and the vertical distance 466 between the bars 460 in each of the two columns is kept small enough (less than the diameter of a golf ball 150) to ensure that each golf ball 150 passing through the apparatus 165D cannot escape from the vertical channel. In this example, the angled distance 464 is 44 mm, and the vertical distance is 30.3 mm.

Thus, the ball 150 has to bounce back and forth between the bars 460 as the ball 150 travels down the vertical channel formed by the two columns of bars 460, and each ball 150 is guaranteed to be redirected (impeded) and likely reoriented multiple times as it travels through the body 400 of the apparatus 165D. This increases the chances of a successful read of the RFID tag in each golf ball 150 to a near certainty. However, if the bars 460 are positioned too close to each other, then the balls 150 can form jams or backups inside the apparatus 165D under high ball throughput conditions, and so the positioning of the bars 460 should provide large enough (but not too large) distances between their outer surfaces to effectively ensure that no ball jams or backups can be formed inside the apparatus 165D.

The optimal spacing between the bars 460 can depend on the size and shape of the bars 460; in this example, each bar/rod 460 is 12.7 mm in diameter. The optimal spacing for a particular implementation can be determined using ball jam/backup and RFID read data from experimental testing for a given apparatus 165D. In general, the spacing can be determined using the following equations:

$$X = -2\left(\sqrt{(Y-Z)(4R+Y+Z)}+R\right)$$

$$X = 2\left(\sqrt{(Y-Z)(4R+Y+Z)}-R\right)$$

$$Y = -\frac{1}{2}\sqrt{20R^2+4R(X+4Z)+X^2+4Z^2}-2R$$

$$Y = \frac{1}{2}\left(\sqrt{20R^2+4R(X+4Z)+X^2+4Z^2}-4R\right)$$

where X is the vertical distance 466 between rods 460, Y is the angled distance 464 between rods 460, Z is the gap 462 for the ball 150, and R is the radius of each rod 460.

Similar calculations can be used to determine the distance between protrusions 210 and/or 410 based on chosen size(s) and shape(s) for the bars 210 and/or protuberances 410, in various embodiments. However, the calculations will change a bit when protuberances 410, 426 are shorter than the radius of a golf ball.

Figure 4C:
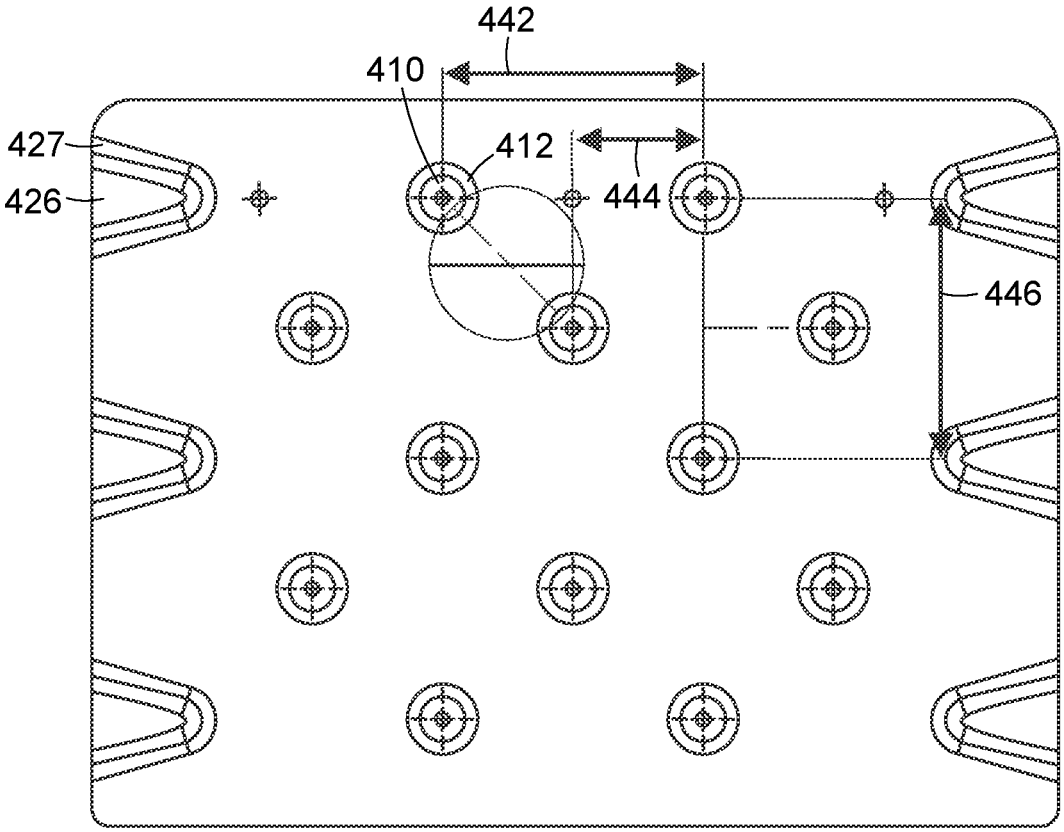
FIG. 4C is a top down view of a support surface from the golf ball receiving apparatus of FIG. 4A.

FIG. 4C is a top down view of a support surface 428, 430 from the golf ball receiving apparatus of FIG. 4A. In this example, the each protuberance 410, 426 has an upper portion that will interact with the golf ball 150, plus a lower portion 412, 427 that flares out as it approaches the surface on which each ball 150 rests as it rolls down the support 428, 430, where the upper portion impacts each golf ball 150 either at the ball's full radius point (i.e., the protuberances 410, 426 are at least as tall as the radius of the golf ball 150) or below this full radius point (i.e., the protuberances 410, 426 are shorter than the radius of the golf ball 150). In this case, the horizontal spacing, angled spacing, and vertical spacing determinations based on rod diameter are based on the distances between the outer surfaces of the upper portions of each protuberance 410, 426. In general, the overlap between golf balls 150 and protrusions 410, 426 is designed to force direction change for each ball 150 rolling down the support 428, 430.

In this example, each protrusion 410, 426 is less than half the diameter of the ball 150, e.g., 12 mm tall, which means the protrusions/pegs 410, 426 do not extend to the ball's mid-line (making overlap possible from a top view layout) and the Galton configuration is formed using protrusions/pegs 410 with a horizontal distance 442 between centers of protrusions/pegs 410 in a same row of 73 mm, a horizontal distance 444 between centers of protrusions/pegs 410 in alternating rows of 36.5 mm, and vertical distance 446 between centers of protrusions/pegs 410 in every other row of 73 mm. This spacing means the angled distance between the centers of protrusions/pegs 410 in alternating rows is 51.618795 mm. This provides just enough angled distance between the protuberances/pegs 410 in the Galton pattern to allow one golf ball 150 to pass through each opening at a time, with very little clearance on either side; note that part of the ball 150 (at its midline) actually passes over each protrusion/peg that it impacts below the ball's midline. Moreover, as more balls come into a full apparatus 165D, those balls will first rest on top of the other balls 150 already on the support 428, and then (under the effects of gravity) naturally drop into place at some point in the Galton pattern as the balls 150 fall into the vertical channel between bars/rods 460. Thus, a large influx of balls can be handled, while no jams or backups of balls can be formed by the golf balls on the support 428, 430.

Nonetheless, if the ball throughput for the apparatus 165 and/or if tilting or debris conditions can occur (e.g., in an environment with snow/ice, wind, windblown trash, and/or leaves) adjustments can be made to the structure to address such issues. In the example of FIG. 4B, each support surface 428, 430 is at an angle of eleven degrees. However, in some implementations the inclined angle of one or each of the support surfaces 428, 430 is adjustable using adjustment mechanisms 470, 472 in a range between ten degrees and twenty degrees (inclusive) or in a range between ten degrees and fifteen degrees (inclusive). Examples of adjustment mechanisms 470, 472 include a set of slots or holes to receive a pin or similar structure (e.g., a bolt the fits into a selected slotted hole and is held in place with a nut) or height-adjustable feet (e.g., a bolt that is turned to increase or decrease the angle) used to support one end of each of the support surfaces 428, 430. In general, the angle of the incline of each support 428, 430 should be at least eight, nine, ten or eleven degrees in order to ensure that the balls 150 will roll out of the apparatus 165 in the event that there is debris inside the apparatus 165 and/or the apparatus 165 has been tilted.

While this specification contains many implementation details, these should not be construed as limitations on the scope of what is being or may be claimed, but rather as descriptions of features specific to particular embodiments of the disclosed subject matter. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination. Thus, unless explicitly stated otherwise, or unless the knowledge of one of ordinary skill in the art clearly indicates otherwise, any of the features of the embodiments described above can be combined with any of the other features of the embodiments described above.

Thus, particular embodiments of the invention have been described. Other embodiments are also possible and may be claimed and/or be within the scope of the following claims. For example, the structures can be scaled up and reinforced to handle balls other than golf balls, such as baseballs, softballs, or bowling balls with embedded RFID tags. As another example, the apparatus 165D can be designed to have two egress sides (as shown for apparatus 165A in FIG. 2D) and/or two separate vertical channels formed by bars 460, although when the rods 460 are to be made of metal, fewer rods 460 may be preferred in order to reduce the overall weight and manufacturing costs of the apparatus 165. For example, when the bars and body are made of metal, the weight of apparatus 165D (with two open sides) will be substantially lower than the weight of apparatus 165A.

What is claimed is:

1. An apparatus comprising:

a body having an ingress and an egress for golf balls passing through the body, wherein each of the golf balls includes a radio frequency identification tag;

at least one antenna of a radio frequency identification reader, the at least one antenna arranged with respect to the body to receive information from the golf balls for identification of the golf balls;

multiple protrusions located within the body, the multiple protrusions being positioned with respect to each other in a Galton configuration that both (i) impedes the golf balls from passing through the body without being read by the radio frequency identification reader, and (ii) allows the golf balls to pass through the body without jamming therein;

a first support surface and a second support surface, wherein the multiple protrusions comprise protuberances on the first support surface or the second support surface; and horizontally oriented bars located within the body, the horizontally oriented bars being arranged in two columns extending between the first support surface and the second support surface, wherein a gap between the bars of the two columns is less than a diameter of a golf ball, and a vertical distance between adjacent bars in each respective column is less than the diameter of a golf ball.

2. The apparatus of claim 1, wherein the protuberances are arranged in a Galton configuration on each of the first and second support surfaces, and each of the first and second support surfaces are placed at an incline of between ten degrees and twenty degrees.

3. The apparatus of claim 2, wherein the incline of each support surface is adjustable between ten degrees and twenty degrees.

4. The apparatus of claim 1, wherein opposite sides of the body are open to the environment.

5. The apparatus of claim 1, comprising an access door forming a majority of an area of at least one side of the body.

6. The apparatus of claim 1, wherein the egress comprises two egresses, and the second support surface is a bottom support surface within the body that has a first portion sloped downward toward a first of the two egresses and a second portion sloped downward toward a second of the two egresses.

7. The apparatus of claim 1, wherein the at least one antenna is placed on a side of a read zone of the body.

8. The apparatus of claim 1, wherein the at least one antenna is placed above a read zone of the body.

9. The apparatus of claim 1, wherein the at least one antenna is placed below a read zone of the body.

10. A system comprising:

targets for golf balls that include radio frequency identification tags;

multiple ball receiving apparatuses included in at least one of the targets; and at least one radio frequency identification reader associated with the at least one of the targets;

wherein each of the multiple ball receiving apparatuses comprises a body having an ingress and an egress for the golf balls passing through the body, at least one antenna coupled with the at least one radio frequency identification reader, the at least one antenna arranged with respect to the body to receive information from the golf balls for identification of the golf balls, multiple protrusions located within the body, the multiple protrusions being positioned with respect to each other in a Galton configuration that both (i) impedes the golf balls from passing through the body without being read by the radio frequency identification reader, and (ii) allows the golf balls to pass through the body without jamming therein, a first support surface and a second support surface, wherein the multiple protrusions comprise protuberances on the first support surface or the second support surface, and horizontally oriented bars located within the body, the horizontally oriented bars being arranged in two columns extending between the first support surface and the second support surface, wherein a gap between the bars of the two columns is less than a diameter of a golf ball, and a vertical distance between adjacent bars in each respective column is less than the diameter of a golf ball.

11. The system of claim 10, wherein the protuberances are arranged in a Galton configuration on each of the first and second support surfaces, and each of the first and second support surfaces are placed at an incline of between ten degrees and twenty degrees.

12. The system of claim 11, wherein the incline of each support surface is adjustable between ten degrees and twenty degrees.

13. The system of claim 10, wherein opposite sides of the body are open to the environment.

14. The system of claim 10, wherein each of the multiple ball receiving apparatuses comprises an access door forming a majority of an area of at least one side of the body.

15. The system of claim 10, wherein the egress comprises two egresses, and the second support surface is a bottom support surface within the body that has a first portion sloped downward toward a first of the two egresses and a second portion sloped downward toward a second of the two egresses.

16. The system of claim 10, wherein the at least one antenna is placed on a side of a read zone of the body.

17. The system of claim 10, wherein the at least one antenna is placed above a read zone of the body.

18. The system of claim 10, wherein the at least one antenna is placed below a read zone of the body.

* * * * *